United States Patent [19]

Hebert et al.

[11] 4,373,346

[45] Feb. 15, 1983

[54] PRECOOL/SUBCOOL SYSTEM AND CONDENSER THEREFOR

[76] Inventors: Thomas H. Hebert, 4815 Sevena Dr.; Theodore M. Hebert, 10225 Hyaleah Rd., both of Tampa, Fla. 33617

[21] Appl. No.: 247,247

[22] Filed: Mar. 25, 1981

[51] Int. Cl.[3] ..... F25B 7/00

[52] U.S. Cl. ..... 62/79; 62/99; 62/160; 62/179; 62/238.6; 62/324.1

[58] Field of Search ..... 62/79, 238.6, 324.1, 62/160, 180–183, 98, 99, 118, 434, 513, 185, 179

[56] References Cited

U.S. PATENT DOCUMENTS

| | | | |
|---|---|---|---|
| 2,548,508 | 4/1951 | Wolfner | 62/332 X |
| 2,893,218 | 7/1959 | Harnish | 62/324.1 |
| 2,975,609 | 3/1961 | Allander et al. | 62/179 X |
| 3,188,829 | 6/1965 | Siewept et al. | 62/160 |
| 3,362,184 | 1/1968 | Jensen | 62/160 |
| 3,976,123 | 8/1976 | Davies | 62/238.6 |
| 4,089,667 | 5/1978 | Jonsson | 62/238.6 |
| 4,098,092 | 7/1978 | Singh | 62/324.1 |
| 4,173,865 | 11/1979 | Sawyer | 62/160 X |

*Primary Examiner*—Lloyd L. King
*Attorney, Agent, or Firm*—Stefan V. Stein

[57] ABSTRACT

The apparatus of the invention includes a precooler (post heater) heat exchanger and a subcooler heat exchanger which are connected in fluid communication with the refrigerant input and output, respectively, of the condenser (evaporator) of a heat transfer system. A fluid, such as water, is forced through the subcooler heat exchanger and then through the precooler (post heater) heat exchanger to be in a heat exchanging relationship with the refrigerant flowing therethrough.

The method of the invention includes the step of regulating the flow rate of the water flowing through the apparatus such that the refrigerant is precooled to approximately its saturated-vapor state and subcooled when the system is operating in a cooling mode and such that the refrigerant is post heated to at least a saturated-vapor state and subcooled when the system is operating in a heating mode.

23 Claims, 12 Drawing Figures

PRECOOL/SUBCOOL SYSTEM AND CONDENSER THEREFOR

BACKGROUND OF THE INVENTION

1. Field of the Invention

This invention relates to air conditioning systems and heat pumps. More particularly, this invention relates to an apparatus and method for precooling and subcooling the refrigerant which is condensed by the condenser of the air conditioning system or heat pump operating in a cooling mode. Additionally, this invention relates to an apparatus and method for post heating and subcooling the refrigerant which is evaporated by the evaporator of a heat pump operating in a heating mode.

2. Description of the Prior Art

Presently there exists many types of apparati designed to operate in a thermal transfer cycle to remove heat from one heat sink region and transfer such heat to a different heat sink region. Such apparati include reverse cycle heat pumps and vapor-compression refrigeration systems such as air conditioners, refrigerators, freezers and coolers.

The operation of the thermal transfer cycle of each of the above apparati can be briefly summarized in relation to the various components thereof. More particularly, the thermal transfer cycle is customarily accomplished by a compressor, condenser, throttling device, and evaporator connected in serial fluid communication with one another. The system is charged with a refrigerant which circulates through each of the components to remove heat from the evaporator and transfer such heat to the condenser. During operation, the compressor compresses the refrigerant from a saturated-vapor state to a super-heated vapor state thereby increasing the temperature, enthalpy, and pressure of the refrigerant. The refrigerant then flows through the condenser which condenses the refrigerant at a substantially constant pressure to a saturated-liquid state. The throttling device reduces the pressure of the refrigerant thereby causing the refrigerant to change to a mixed liquid-vapor state. The refrigerant then flows through the evaporator which causes the refrigerant to return at a constant pressure to its saturated-vapor state thereby completing the thermal transfer cycle.

In a refrigerating mode, it is readily apparent that the condenser plays a major role in the refrigerating effect of the thermal transfer cycle. The most common type of condenser presently in use for domestic systems is commonly referred to as an "air-cooled condenser". Such air-cooled condensers typically operate by subjecting the condenser to a flow of free air which absorbs the heat being discharged by the condenser. The advantages of such air condensers include the low cost of moving the free air by means of fans powered by electric motors, the availability of air, and the ease of discharging the heat laden air. The disadvantages of such air condensers is the need for an extremely large heat exchange surface area of the condenser to effect the heat exchanging relationship between the refrigerant passing through the condenser and the flow of free air, the relatively high head pressure involved on the compressor, the fluctuating humidity and temperature of the air, and the lack of any significant subcooling of the liquid refrigerant flowing from the condenser of standard operating conditions. Because of such problems, the air-type condensers are used in conjunction with relatively small refrigeration systems such as those commonly used for domestic purposes.

The second most prevalent type of condenser is what is commonly referred to as a water-cooled condenser in which water is circulated about the condenser to absorb the latent heat of condensation of the refrigerant as the refrigerant is condensed within the condenser. The advantages of such water cooled condensers is the fact that the condenser drops the head pressure off the compressor very rapidly, thereby reducing the pressure differential across the compressor. The amount of electric current required to power the compressor is therefore substantially reduced. Moreover, water-cooled condensers cool the refrigerant by as much as 30° F. or more over an air-cooled condenser. Such subcooling increases the refrigerating effect of the refrigeration cycle by 18 percent to 37 percent or more. Unfortunately, the primary disadvantage of a water cooled condenser is the need for a great volume of water (approximately 2 gallons per minute per tonnage of cooling capacity as recommended by most manufacturers). Additionally, problems exist in discharging the heated water to the environment. For these reasons, water cooled condensers are typically found only on commercial refrigeration systems having cooling capacities greater than 3 tons (12,000 British Thermal Units per hour).

In order to reduce the volume of water discharged in a water-cooled condenser, various water tower condensers have been designed. Typical water tower condensers comprise a reservoir of water which is pumped through a water/refrigerant heat exchanger. The water absorbs heat of condensation of the refrigerant. The absorbed heat in the water is then rejected into the atmosphere by evaporation of some of the water, with the heat evaporazation of the water being used to cool the remaining water. It is noted that due to the evaporation of water, a supply of water must be continually fed to the reservoir to maintain the reservoir at a proper water level. The equilibrium water temperature attainable is equal to the ambient wet bulb temperature. This causes similar problems as noted on air-cooled condensers, because as ambient wet bulb temperature increases, the efficiency of the condenser decreases.

Therefore, it is an object of this invention to provide an apparatus and method which overcomes the aforementioned inadequacies of the prior art devices and provides an improvement which is a significant contribution to the advancement of the thermal cycle transfer art.

Another object of this invention is to provide an apparatus and method which utilizes the advantages of an air-cooled condenser and a water-cooled condenser while eliminating the disadvantages of such condensers.

Another object of this invention is to provide an apparatus and method for precooling the refrigerant prior to the refrigerant flowing into the condenser when the system is operating in a cooling mode.

Another object of this invention is to provide an apparatus and method for subcooling the refrigerant flowing from the condenser when the system is operating in a cooling mode.

Another object of this invention is to provide an apparatus and method for subcooling the refrigerant flowing into the evaporator when the system is operating in a heating mode.

Another object of this invention is to provide an apparatus and method for post heating the refrigerant flowing from the evaporator when the system is operating in a heating mode.

Another object of this invention is to provide an apparatus and method to prevent damage to a compressor due to excessive subcooling when the heat pump is operated in a cooling mode at extremely low outside temperatures.

Another object of this invention is to provide an apparatus and method to prevent damage to a compressor when operating the heat pump in a cooling mode at elevated outside air temperatures.

The foregoing has outlined some of the more pertinent objects of the invention. These objects should be construed to be merely illustrative of some of the more prominent features and applications of the intended invention. Many other beneficial results can be attained by applying the disclosed invention in a different manner or modifying the invention within the scope of the disclosure. Accordingly, other objects and a fuller understanding of the invention may be had by referring to the summary of the invention and the detailed description describing the preferred embodiment in addition to the scope of the invention defined by the claims taken in conjunction with the accompanying drawings.

SUMMARY OF THE INVENTION

The invention is defined by the appended claims with a specific embodiment shown in the attached drawings. For the purpose of summarizing the invention, the invention comprises an apparatus and method for precooling and subcooling the refrigerant as the refrigerant flows into and is discharged from the condenser of a heat pump operating in a cooling mode. The apparatus and method of this invention also functions to subcool and post heat the refrigerant as the refrigerant flows into and is discharged from the evaporator of the heat pump operating in a heating mode. More particularly, the apparatus and method of this invention may be incorporated into any type of refrigeration device or straight cooled air conditioner having air-cooled condensers or water-cooled condensers, heat pumps having air-cooled or water-cooled condensers and evaporators which operate in conjunction with expansion valves or capillary tubes, centrifugal chillers, water tower applications, ground grid or waste water applications or basically any system that uses a heat transfer cycle.

Basically, the apparatus, when the heat pump is operating in a cooling mode, includes a subcooler having a heat exchanger disposed in a heat exchanging relationship with the input of the condenser and a precooler having another heat exchanger disposed in heat exchanging relationship with the output of the condenser. A fluid, such as water, is circulated through the heat exchanger of the subcooler and then through the heat exchanger of the precooler.

Accordingly, the precooler and the subcooler of the invention functions to precool the refrigerant flowing from the compressor into the condenser. Such precooling operates to reduce the temperature of the refrigerant until the refrigerant begins to change from its gaseous state to a liquid state. Upon entering the condenser, the refrigerant is further cooled by the condenser whereupon the great majority of the phase change of the refrigerant occurs. Upon being discharged from the condensed, the refrigerant is subcooled to a lower temperature substantially equal to the temperature of the water flowing into the subcooler. Because the refrigerant is now completely in a liquid state, the subcooler operates to merely reduce the temperature of the refrigerant. It should be appreciated that the precooler and subcooler of this invention operate to primarily reduce the temperature of the refrigerant prior to entering and upon being discharged, respectively, from the condenser with the bulk of the phase changing of the refrigerant occurring in the condenser itself. It should now be apparent that the flow rate of the water through the precooler and subcooler needed for maximum efficiency, is substantially less than a straight water-cooled condenser. Experience has shown that the precooler and subcooler of this invention, when used in conjunction with an air-cooled condenser, uses only 1/20th of the amount of water required for a straight water-cooled condenser. For these reasons, the precooler and subcooler of this invention is able to produce as much as a net 30–96% or more increase in efficiency over existing air-cooled air conditioners or heat pumps when retrofitted thereto.

The foregoing has outlined rather broadly the more pertinent and important features of the present invention in order that the detailed description of the invention that follows may be better understood so that the present contribution to the art can be more fully appreciated. Additional features of the invention will be described hereinafter which form the subject of the claims of the invention. It should be appreciated by those skilled in the art that the conception and the specific embodiment disclosed may be readily utilized as a basis for modifying or designing other structures for carrying out the same purposes of the present invention. It should also be realized by those skilled in the art that such equivalent constructions do not depart from the spirit and scope of the invention as set forth in the appended claims.

BRIEF DESCRIPTION OF THE DRAWINGS

For a fuller understanding of the nature and objects of the invention, reference should be had to the following detailed description taken in connection with the accompanying drawings in which.

Similar reference characters refer to similar parts throughout the several views of the drawings.

DETAILED DESCRIPTION

For purposes of the following discussion and the appended claims, the term "heat pump" shall be defined to include any type of apparatus designed to operate in a thermal transfer cycle to remove heat from one heat sink region and transfer that heat to a different heat sink region.

Figure 1:
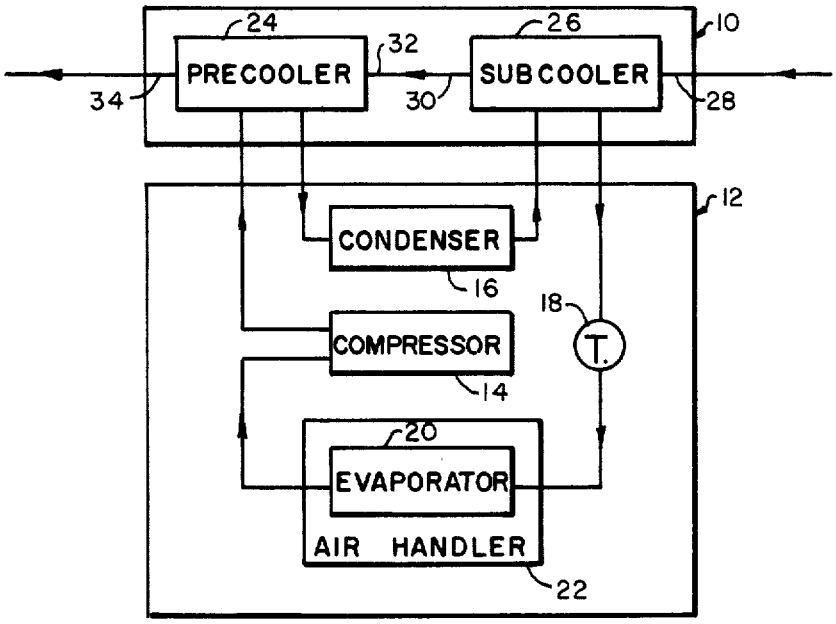
FIG. 1 is a hardware schematic of the precool/subcool system of the invention incorporated into a typical heat pump operating in a cooling mode.

FIG. 1 is a hardware schematic of the precool/subcool system 10 of the invention incorporated into a typical heat pump 12 operating in a cooling mode. Basically, the heat pump 12 comprises a compressor 14, condenser 16, throttling device 18, and evaporator 20 connected in serial fluid communication with one another. The heat pump 12 is charged with a refrigerant which circulates through the system to remove heat from the evaporator 20 and transfer such heat along with the heat produced upon compression of the refrigerant by compressor 14 to the condenser 16. The evaporator 20 is disposed within an air handling unit generally indicated by the numeral 22, which circulates air about the evaporator 20 thereby cooling the air. It should be understood that the air handling unit 22 may alternatively comprise a fluid handling unit which circulates a fluid about the evaporator 20 thereby cooling the fluid.

The precooler 24 of the subject invention is interconnected in fluid communication between the compressor 14 and condenser 16 thereby enabling the gaseous refrigerant to flow therethrough. Similarly, the subcooler 26 of this invention is interconnected between condenser 16 and evaporator 20 enabling the condensed refrigerant to flow therethrough. A fluid, such as water, is forced into subcooler 26 via input 28 to flow therethrough in a heat exchanging relationship with the refrigerant being discharged from condenser 16. The water then exits through output 30 of the subcooler and into input 32 of the precooler. The water flows in a heat exchanging relationship with the compressed refrigerant and is discharged from the precooler 24 via output 34.

Figure 2:
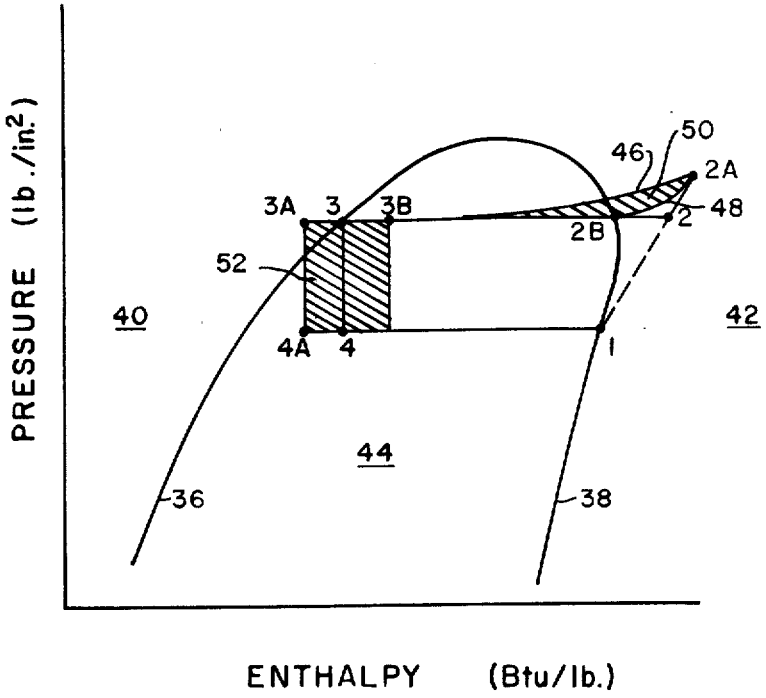
FIG. 2 is a process representation of the heat pump illustrated in FIG. 1.

FIG. 2 is a process representation of a typical heat pump 12 having the precool/subcool system 10 of the invention incorporated therein. More particularly, the process representation is represented by a pressure-enthalpy diagram which illustrates the particular thermodynamic characteristics of a typical refrigerant. The diagram illustrates a vapor dome of the refrigerant defined by a saturated-liquid line 36 and a saturated-vapor line 38. The area represented by numeral 40 to the left of the saturated-liquid line 36 is commonly referred to as the subcooling region and the area 42 to the right of the saturated-vapor line 38 is commonly called the super heated-vapor region. Finally, the area represented by the numeral 44 contained within the vapor dome between the saturated-liquid line 36 and the saturated-vapor line 38, is commonly called the mixed-phase region.

Theoretically, the refrigeration cycle of the heat pump 12 (without the invention incorporated therein), can be summarized as follows. The compressor 14 compresses the refrigerant from a saturated-vapor state represented by point 1 on the diagram to a superheated-vapor state represented by point 2 thereby increasing the temperature, enthalpy and pressure of the refrigerant. The refrigerant then flows through the condenser 16 wherein the enthalpy of the refrigerant is reduced at a constant pressure thereby causing the refrigerant to change from a superheated-vapor state to a saturated-liquid state, represented by point 3 of the diagram. The refrigerant flows through a throttling device 18 which reduces the pressure of the refrigerant at constant enthalpy to a mixed-phase state represented by point 4. The refrigerant then flows through the evaporator 20 which increases the enthalpy of the refrigerant at a constant pressure until the refrigerant is again in a saturated-vapor state represented by point 1 on the diagram. In actual practice, it is well known that the compressor 14 compresses the refrigerant to a higher superheated-vapor region represented by point 2A on the diagram. The refrigerant then flows through the condenser 16 along line 46 until the refrigerant is in a saturated-liquid state. It is noted that line 46 gradually slopes from point 2A to point 3.

The refrigeration cycle of the heat pump 12 having the precool/subcool system 10 of the invention incorporated therein is described as follows. Upon being compressed by compressor 14 to a superheated-vapor state represented by point 2A, the water flowing into the input 32 of the precooler 24 of the invention causes the temperature of the refrigerant to be more rapidly decreased, as represented by line 48. Such precooling causes the refrigerant to be reduced from its superheated-vapor state to at least a saturated-vapor state represented by point 2B. It is noted that by increasing the flow rate of the water through the precooler 24, the precooler 24 can further decrease the temperature of the refrigerant thereby causing the refrigerant to change from its superheated-vapor state to a mixted-phase state composed primarily of vapor. Accordingly, the shaded area 50 between line 46 and 48 illustrates the magnitude of the increased efficiency of the heat pump 12 having the precooler 24 incorporated therein.

The subcooler 26 operates to subcool the refrigerant being discharged from the condenser 16 thereby causing the refrigerant to change from a saturated-liquid state represented by point 3 on the diagram to a subcooled state represented by point 3A. The refrigerant then flows through the throttling device 18 which causes the refrigerant to change from a subcooled state to a mixed-phase state, represented by point 4A on the diagram. Accordingly, the shaded area 52 on the diagram illustrates the increased efficiency of the heat pump 12 having the subcooler 26 incorporated therein. The degree of subcooling is dependent upon the flow rate of the water through the input 28 of the subcooler 26. When the condenser 16 of the heat pump 12 is exposed to elevated outside temperatures, the condenser 16 may only condense the refrigerant to a mixed-phase state composed primarily of liquid, represented by point 3B. When this occurs, the subcooler 26 cools the refrigerant to assure that the refrigerant changes to at least a saturated-liquid state or further to a subcooled state. The size of the shaded area 52 representing the increased efficiency of the heat pump 12 is therefore greatly increased.

It should be appreciated that the precooler 24 and the subcooler 26 of the invention reduces the temperature of the refrigerant as the refrigerant passes therethrough, with the bulk of the phase change of the refrigerant being accomplished by the condenser 16. Accordingly, the flow rate of the water circulated through the subcooler 26 and the precooler 24 needed for maximum efficiency of the refrigeration cycle is greatly reduced from that amount of water needed for a straight water-cooled condenser. Such a reduction in required flow rate of water can be best illustrated by way of example.

The calculations which follow are based upon a three ton heat pump 12 being charged with R-22 refrigerant and having the precool/subcool system of the invention incorporated therein. The calculations are provided for illustrating the relatively low flow rate of the water through the precooler 24 and the subcooler 26 and the resulting substantial increase in the energy efficient ratio (E.E.R.) of the heat pump 12. The following are well recognized definitions.

| | | |
|---|---|---|
| $C_{p,g}$ | = | heat capacity of gaseous refrigerant (R-22) |
| | = | 0.01 (Btu/lb/°F.) for gas in range of 104° to 148° |
| $C_{p,L}$ | = | heat capacity of liquid refrigerant (R-22) |
| | = | 0.31 (Btu/lb/°F.) for liquid in range of 72° to 102° F. |
| $C_{p,w}$ | = | heat capacity of water |
| | = | 1.0 (Btu/lb/°F.) |
| W | = | weight of refrigerant circulated per ton |
| | = | $\frac{200}{\text{R.E.}}$ (lb/Min/ton), where |
| R.E. | = | refrigerating effect = ΔH |
| | = | enthalpy (H) of saturated vapor in the evaporator (dependent on temperature of evaporator) minus enthalpy (H) of liquid ahead of throttling device (dependent on temperature of liquid refrigerant). |
| $M_R$ | = | Mass flow rate of refrigerant |
| | = | W × # of tons (lb/min) |
| $M_W$ | = | Mass flow rate of water (lb/min) |
| $\Delta T_L$ | = | Change in liquid refrigerant temperature |
| $\Delta T_g$ | = | Change in gaseous refrigerant temperature |
| $\Delta T_W$ | = | Change in water temperature |

The flow rate of the water through the subcooler 26 when the evaporator temperature is equal to 40° F. and the liquid temperature is 72° F. is computed as follows:

Enthalpy (H) of evaporator temperature at 40° F.=108.142 (Btu/lb)

$R.E.=\Delta H=77.43$ (Btu/lb)

$M=(200/\text{R.E.})\times 3$ tons=7.74 lb/min $\Delta T_L=33°$ F.

$$C_{p,L} = 0.31 \frac{\text{(Btu/lb)}}{°\text{F.}}$$

The temperature of the water flowing into and being discharged from the subcooler is measured to be 72° F. and 102° F., respectively. Accordingly, $\Delta T_w=30°$ $C_{p,w}=1$ (Btu/lb/°F.)

By definition, $C_{p,L}\times M_R\times \Delta T_R=C_{p,w}\times M_w\times \Delta T_w$ $$\text{Solving for } M_w: = \frac{C_{p,L}\times M_R\times \Delta T_R}{C_{p,w}\times \Delta T_w}$$

$$= 0.32 \text{ Gal/min,}$$

Or, determining the flow rate of the water required per ton, $$M_w/\text{ton} = \frac{0.32 \text{ Gal/min}}{3 \text{ ton}} = 0.1 \text{ Gal/min/Ton}$$

The flow rate of the water through the precooler 24 when the condenser gaseous temperature is equal to 220° F. and the liquid temperature is 105° F. is computed as follows:

$\Delta T_g=115°$ F.

$C_{p,g}=0.01$ (Btu/lb/°F.)

The temperature of the water flowing into and being discharged from the precooler is measured to be 102° F. and 132° F., respectively. Accordingly, $\Delta T_w=30°$ F.

$C_{p,w}=1$ (Btu/lb/°F.)

By definition, $C_{p,g}\times M_R\times \Delta T_R=C_{p,w}\times M_w\times \Delta T_w$ Solving for $$M_w = \frac{C_{p,g}\times M_R\times \Delta T_R}{C_{p,w}\times \Delta T_w}$$

$$= 0.04 \text{ Gal/min,}$$

where 1 Gal of water=8.3 lb.

Or, determining the flow rate of the water required per ton, $$M_w/\text{Ton} = \frac{0.04 \text{ Gal/min.}}{3 \text{ ton}} = 0.0133 \text{ Gal/min/ton}$$

It should be appreciated that the flow rate of the water through the subcooler equals 0.1 gal/min per ton whereas the flow rate through the precooler equals 0.0133 gal/min per ton. This should be compared to the 2 gal/min per ton recommended for a straight water-cooled condenser.

The Energy Efficient Ratio (E.E.R.) of a heat pump 12 having the precool/subcool system 10 of the invention retrofitted thereto is substantially increased as shown by the following data and calculations of a heat pump 12 with and without the invention incorporated therein. The following are well recognized definitions:

$$\text{E.E.R.} = \frac{\text{Btu hours produced by heat pump}}{\text{Watts of electrical power needed}}$$

$$= \frac{q}{V\times A\times \text{P.F.}} \text{ where,}$$

| | | |
|---|---|---|
| V | = | volts |
| A | = | amperes |
| P.F. | = | power factor (assume to be 0.85) |
| and, | | |
| q | = | 4.5 (CFM) ΔH where, |
| CFM | = | cubic feet of air per minute passing through evaporator |
| ΔH | = | change of enthalpy of air passing through evaporator |
| WB | = | Wet bulb temperature |
| DB | = | Dry bulb temperature |

The actual measurements are tabulated as follows:

| | heat pump w/out invention | heat pump with invention |
|---|---|---|
| total air volume (CFM) | 800 | 800 |
| Amperage draw | 21.0 | 17.0 |
| head pressure | 260 | 215 |
| voltage | 220 | 220 |
| Condenser entering | 70DB | 70DB |
| air temperature °F. | 63WB | 63WB |
| Evaporator entering | 75DB | 75DB |
| air temperature °F. | 68WB | 68WB |
| Evaporator existing | 59DB | 54DB |
| air temperature °F. | 55WB | 50WB |

The enthalpy of the air flow through the evaporator is determined by the thermodynamic characteristics of the refrigerant being used. With a R-22 refrigerant, the enthalpy of the air at 75° DB & 68° F. WB, 59° DB & 55° F. WB, and 54° DB & 50° F. WB, is equal to 32.4, 24.2, and 20.2 (Btu/lb), respectively. Solving for the E.E.R. of a heat pump 12 with and without the invention retrofitted thereto reveals the following:

| | |
|---|---|
| E.E.R. (without invention) | = 7.52 |
| E.E.R. (with invention) | = 13.81 |

Accordingly, an 84% increase in efficiency has been obtained.

Figure 3:
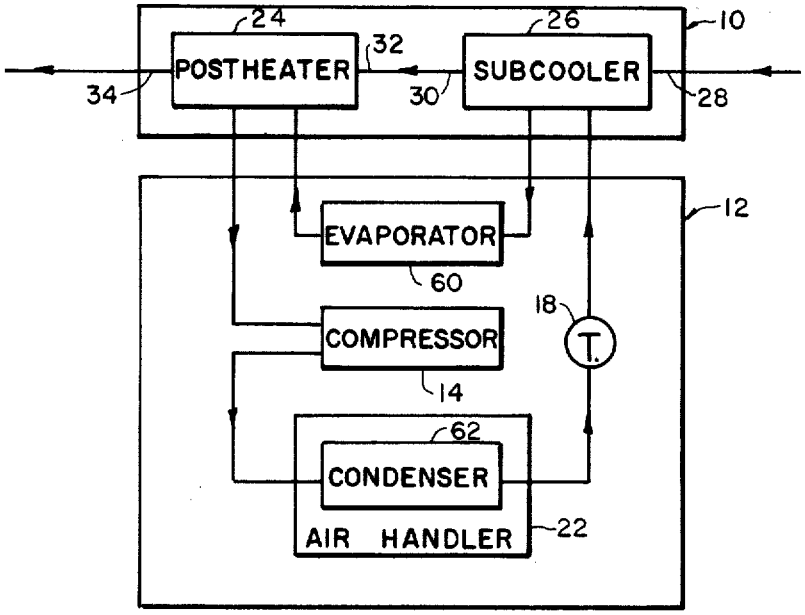
FIG. 3 is a hardware schematic of the precool/subcool system incorporated into a typical heat pump operating in a heating mode.

FIG. 3 is a hardware schematic of the heat pump 12 having the precooled/subcool system 10 of the invention incorporated therein wherein the heat pump 12 acts in a reverse cycle in a heating mode. More particularly, by acting in such a reverse cycle, the cyclic flow of the refrigerant throughout the system is reversed thereby causing the condenser 16 and the evaporator 20 of the heat pump 12 to now function as an evaporator 60 and condenser 62, respectively. It therefore should be appreciated that no modifications need be made to the precooler 24 and the subcooler 26 described previously in order that the heat pump 12 may now operate in a heating mode. It is pointed out however, that the precooler 24 now operates as a post heater which transfers its temperature as energy to the refrigerant flowing from the evaporator 60.

Figure 4:
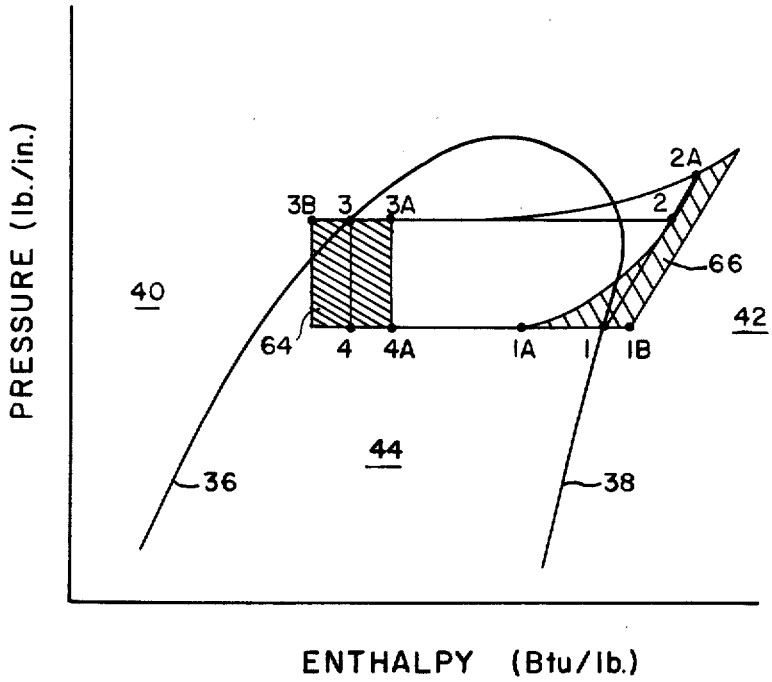
FIG. 4 is a process representation of the heat pump illustration in FIG. 3.

FIG. 4 is a process representation of the heat pump 12 having the precool/subcool system 10 incorporated therein. In theory, the compressor 14 compresses the refrigerant from a saturated-vapor state represented by point 1 on the diagram to a superheated-vapor state represented by point 2. The refrigerant then flows through the condenser 62 which condenses the refrigerant from a superheated-vapor state to a saturated-liquid state represented by point 3. The refrigerant flows through the throttling device 18 which reduces the pressure of the refrigerant at a constant enthalpy to a mixed-phase state represented by point 4 on the diagram. The refrigerant then flows through the evaporator 60 which causes the refrigerant to change from a mixed-phase phase state to return to its saturated-vapor state represented by point 1. In actual practice, the compressor 14 compresses the refrigerant to a higher superheated-vapor state represented by point 2A on the diagram. Upon being condensed by the condenser 62, the refrigerant changes from a superheated-vapor state to a mixed-phase state more accurately represented by point 3A on the diagram. The throttling device 18 reduces the pressure of the refrigerant to another mixed-phase state represented by point 4A at which time the refrigerant is then condensed by the condenser 62 to another mixed-phase state accurately represented by point 1A on the diagram.

The flow rate of the water through the subcooler 26 is regulated to cool the refrigerant being discharged from the evaporator 60 to at least a saturated-liquid state represented by point 3 but preferrably to a subcooled state represented by point 3B on the diagram. The shaded area 64 on the diagram illustrates the increased efficiency of the heat pump 12 when the subcooler 26 subcools the refrigerant. The post heater 24 operates to assure that the refrigerant will change from a mixed-phase state represented by point 1A to at least a saturated-vapor state represented by point 1 on the diagram after the refrigerant is evaporated within the evaporator 60. The post heater 24 may also operate to superheat the refrigerant to a superheated-state represented by point 1B on the diagram prior to the refrigerant entering the compressor 14. The shaded area 66 illustrates the increased efficiency of the heat pump 12 when the post heater 24 post heats the refrigerant.

Figure 5:
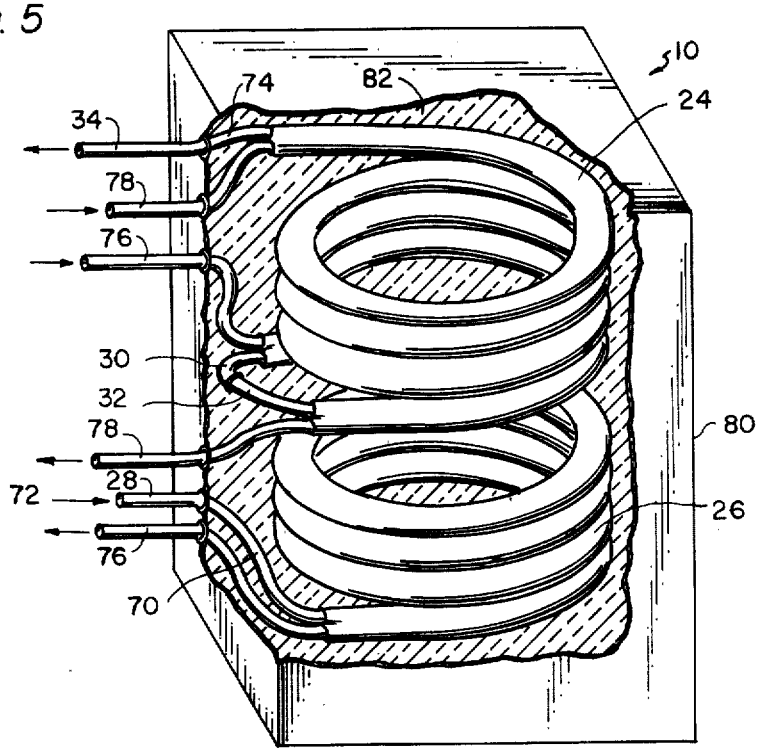
FIG. 5 is a perspective cut-away view of the precooler and subcooler of the invention.

FIG. 5 is a cut-away perspective view of the preferred embodiment of the precooler 24 and subcooler 26 of the precool/subcool system 10 of the invention which may be retrofitted to an existing heat pump 12. More particularly, the subcooler 26 comprises a first fluid conduit 70 having an input 28 for connection to a water source generally indicated by reference numeral 72. The precooler 24 similarly comprises a second fluid conduit 74 having its input 32 connected in fluid communication with output 30 of the first fluid conduit 70. During operation, fluid from the fluid source 72 first enters the subcooler 26 via input 28, flows through the first fluid conduit 70, and is discharged therefrom via output 30 into the input 32 of the second fluid conduit 74. The fluid then flows through the second fluid conduit 74 and is discharged therefrom via output 34. The subcooler 26 further comprises a first refrigerant conduit 76 which is interconnected between the evaporator 20 and the condenser 16 when the heat pump 12 is operating in a cooling mode and between evaporator 60 and condenser 62 when the heat pump 12 is operating in a heating mode. The refrigerant being circulated through the heat pump 12 flows through the first refrigerant conduit 76 in a heat exchanging relationship with the fluid flowing through the first fluid conduit 70 thereby subcooling the refrigerant. The precooler 24 similarly comprises a second refrigerant conduit 78 which is interconnected in fluid communication between the compressor 14 and the condenser 16 when the heat pump 12 is operating in a cooling mode and between the compressor 14 and the evaporator 60 when the heat pump 12 is operating in the heating mode. The refrigerant being circulated through the heat pump 12 flows through the second refrigerant conduit 78 in a heat exchanging relationship with the fluid flowing through the second fluid conduit 74 thereby precooling (or post heating) the refrigerant. Preferably, the first fluid conduit 70 and the first refrigerant conduit are disposed in a heat exchanging relationship with one another by incorporating the first refrigerant conduit 76 within the first fluid conduit 70. Likewise, the second fluid conduit 74 and the second refrigerant conduit 78 are disposed in a heat exchanging relationship by incorporating the second refrigerant conduit 78 within the second fluid conduit 74. Typical heat exchangers of the type just described are commonly referred to as tube in tube heat exchangers. It should be understood that many other types of heat exchangers such as shell and tube heat exchangers may be utilized without departing from the spirit and scope of this invention. As shown in FIG. 5, the refrigerant flowing through refrigerant conduits 76 and 78 flow in a direction opposite to the flow of the fluid through the fluid conduits 70 and 74, respectively, thereby achieving the greatest possible heat exchange between the refrigerant and the fluid.

Figure 6:
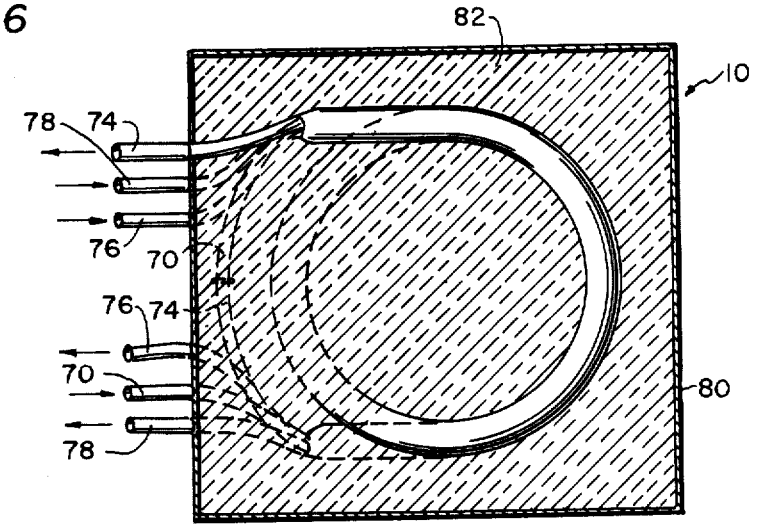
FIG. 6 is a plan view of the interior of FIG. 5.
Figure 7:
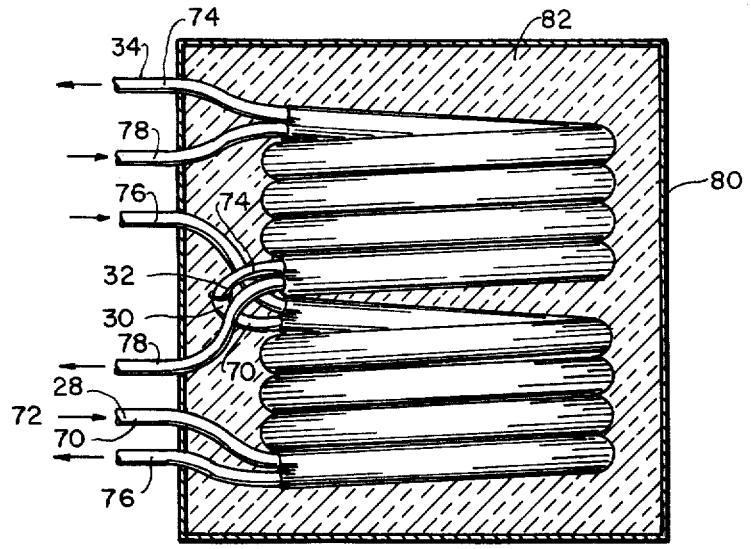
FIG. 7 is a side view of the interior of FIG. 5.

FIGS. 5, 6 and 7 illustrate the manner in which the conduits 70, 74, 76, and 78 are coiled within a rectangular box 80. As shown, conduits 70, 74, 76 and 78 are preferably coiled such that conduits 70 and 76 comprising the subcooler 26 are disposed adjacent the conduits 74 and 78 comprising the precooler 24. After coiling, the box 80 is filled with a rigid, insulative foam 82 which secures the conduits 70, 74, 76 and 78 in position within the box 80 while also protecting and insulating conduits 70, 74, 76 and 78 from the environment.

Figure 8:
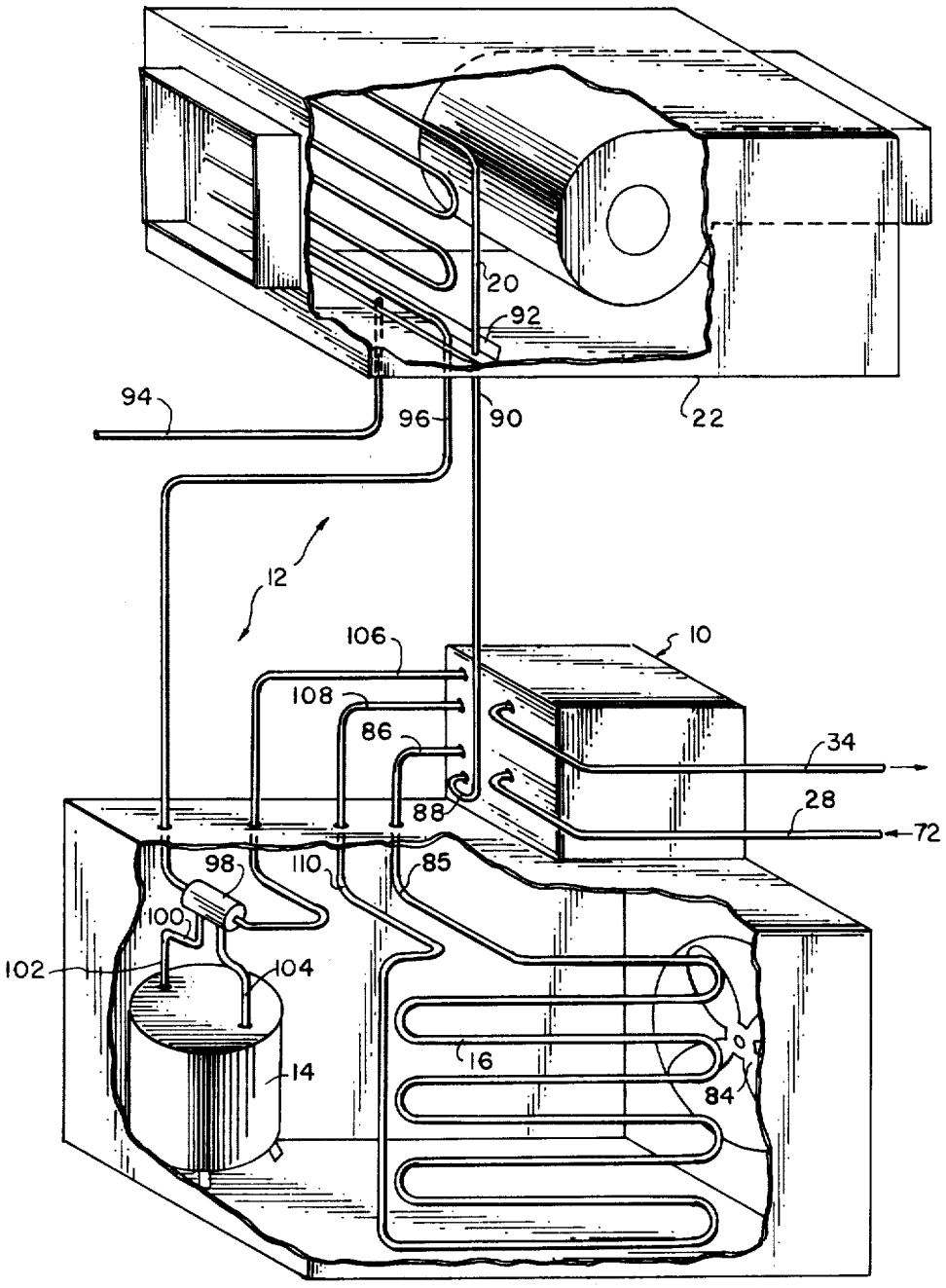
FIG. 8 is a cut-away perspective view of the invention retrofitted to a heat pump.

As noted earlier, the precool/subcool system 10 of the invention may be retrofitted to any type of heat pump 12. FIG. 8 is a simplified cut-away perspective view of a typical heat pump 12 having the precool/subcool system 10 of the invention retrofitted thereto. For the sake of brevity, such a heat pump 12 will be described as if the heat pump 12 is operating in a cooling mode. The heat pump 12 comprises a condenser 16 which is air cooled by a fan means 84 which circulates air over the condenser 16. The output 85 of the condenser 16 is connected to the input 86 of the first refrigerant conduit 76. The output 88 of the first refrigerant conduit 76 is then connected to the input 90 of the evaporator 20 disposed within an air handling unit 22. A trough 92, together with a drainpipe 94, is provided for draining off the condensate forming on the evaporator 20. The output 96 of the evaporator 20 is then connected to a switching valve 98 which controls the operation of the heat pump 12 to switch to and from a cooling mode and a heating mode. The output 100 of the switching valve 98 is connected to the input 102 of the compressor 14. The output 104 of the compressor is connected through the switching valve 98 to the input 106 of the second refrigerant conduit 78. Finally, the output 108 of the second refrigerant conduit 78 is then connected to the input 110 of the condenser 16 thereby completing the refrigeration cycle. A fluid, such as water, is supplied from a fluid source 72 to the input 28 of the first fluid conduit 70 of the subcooler 26 to subcool the refrigerant being discharged from the condenser 16. The fluid flows through the first fluid conduit 70 and then through the second fluid conduit 74 to precool the refrigerant prior to flowing through the condenser 16. The heated fluid is then discharged from the output 34 of the second fluid conduit 74. From the above discussion, it should be apparent that the precooler 24 and subcooler 26 of the precool/subcool system 10 of the invention is easily retrofitted to existing heat pumps 12. Moreover, the precool/subcool system 10 is primarily a passive system which is operable by simply causing a fluid such as water to flow through the first and second fluid conduits 70 and 74.

Figure 9:
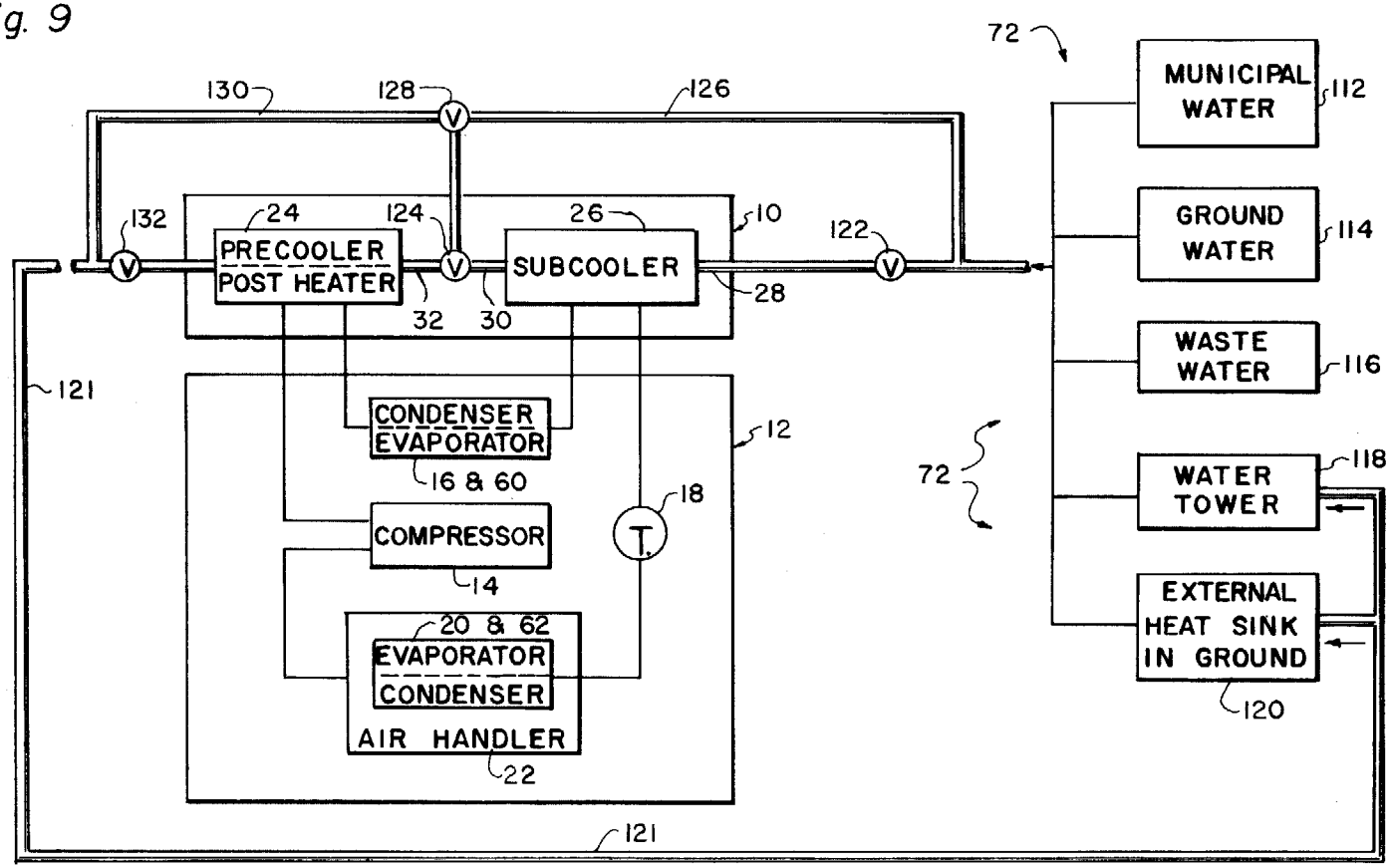
FIG. 9 is a block diagram illustrating the various sources of water which accomplishes the precooling and subcooling of the refrigerant and also illustrates various valve configurations which control the flow rate of the water through the subcooler and precooler.

FIG. 9 is a block diagram of the heat pump 12 having the precool/subcool system 10 of the invention installed therein illustrating the different water sources 72 and the manner in which the water is supplied to the subcooler 26 and the precooler/post heater 24. More particularly, the water sources 72 may comprise municipal water 112 supplied by a city or a county, ground water 114 supplied by a well, waste water 116 supplied, for example, by a manufacturing plant, a water tower 118, a ground heat sink 120, or any combination thereof. In each case, the water supplied by the water sources 112-120 are supplied to the input 28 of the subcooler 26. When a water tower 118 or a ground heat sink 120 is utilized to cool the water, the output 34 of the precooler/post heater 24 is connected to the input of the water tower 118 and the ground heat sink 120 via a return conduit 121. When utilizing the municipal water 112, ground water 114, or waste water 116, the water from the precooler/post heater 24 may be discharged to the environment.

As noted earlier, FIG. 9 also illustrates the manner in which the water is supplied to both the subcooler 26 and the precooler/postheater 24. More particularly, a valve 122 is connected to the input 28 of the subcooler 26 to regulate flow of water therethrough. A three-way valve 124 is interconnected between the output 30 of the subcooler 26 and the input 32 of the precooler/post heater 24. A conduit 126 is connected in fluid communication with the water source 72 and the three-way valve 124. Another three-way valve 128 is interposed within conduit 126 enabling a discharge conduit 130 to be connected in fluid communication with conduit 126. Finally, another valve 132 is connected in fluid communication with the output 34 of the precooler/postheater 24. The output of the discharge conduit 130 and/or the output from valve 132 may be connected in fluid communication with the return conduit 121 enabling the heated water to be fed back to the water tower 118 and/or the external heat sink 120. Each of the valves, or a combination of them, may comprise an electrically operated solenoid gate valve, high side head pressure valve, low side suction pressure valve, a temperature sensing valve, or basically, any type of fluid control device. Accordingly, it should be appreciated that water may be selectively regulated to flow through the subcooler 26 and/or the precooler/postheater 24 at any flow rate. More particularly, the valves 122, 124, 128, and 132 enable the water flow to be regulated such that a greater or lesser amount of water flows through the subcooler 26 than the precooler/postheater 24.

Figure 10:
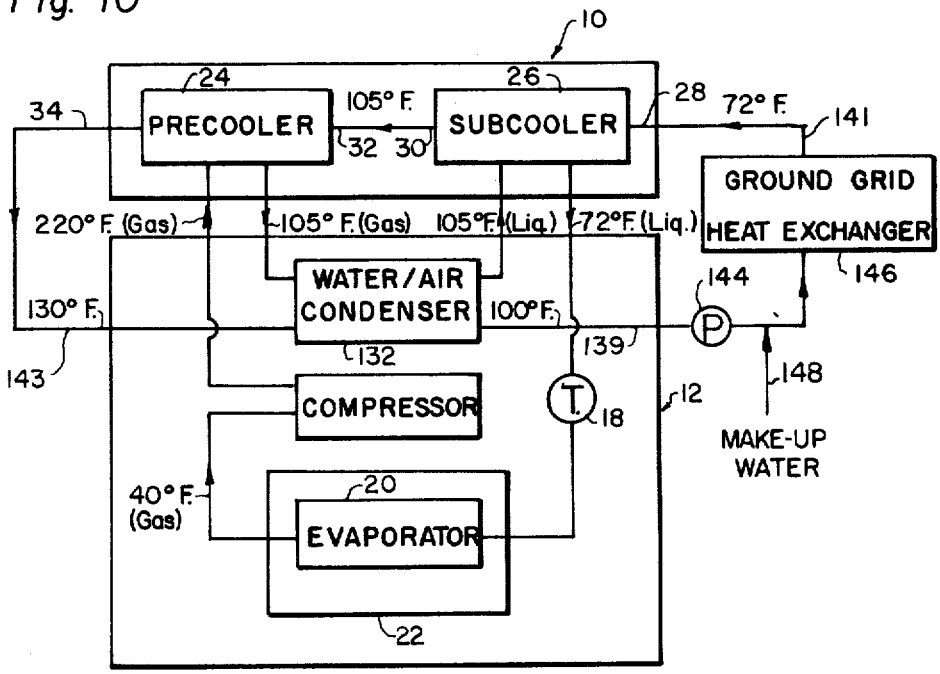
FIG. 10 is a block diagram of the precool/subcool system used in conjunction with a water tower condenser of the invention.
Figure 11:
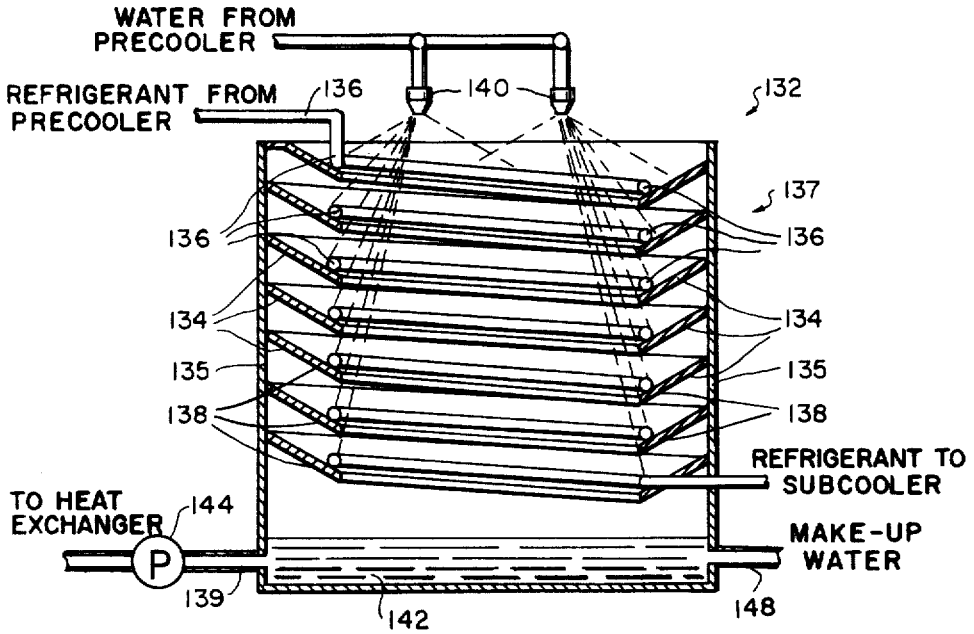
FIG. 11 is a cross-sectional view of the water tower condenser.
Figure 12:
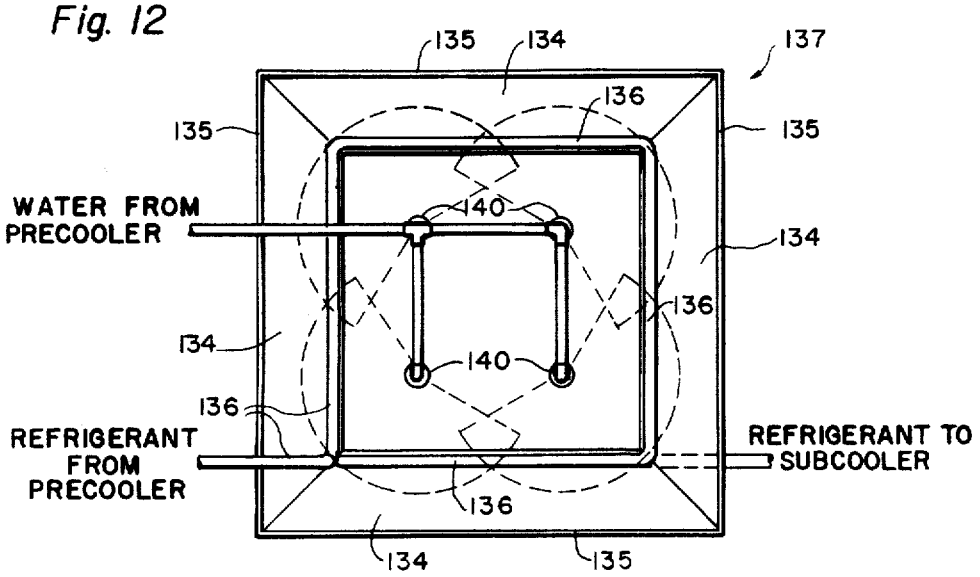
FIG. 12 is a plan view of FIG. 10.

FIGS. 10-12 illustrate an improved combination water and air-cooled condenser 132 of the invention. More particularly, the condenser 132 comprises a plurality of baffles 134 vertically disposed with respect to one another and angularly sloped inwardly from the substantially rectangular framework 135 of the tower 137. A condenser conduit 136 is rigidly connected to the lowermost edge 138 of each of the baffles 134 such that the conduit 136 forms a coil within the tower 137. The output 34 of the precooler 24 is connected in fluid communication with a plurality of spray heads 140 connected to the upper framework 135 above the baffles 134 such that the water sprayed from the spray heads 140 is directed at the baffles 134. A reservoir 142 is positioned below the baffles 134 to catch the sprayed water as the water drips down the baffles 134 and over the condenser conduit 136. A return conduit 139 interconnects the reservoir 142 and a heat exchanger 146 buried within the ground. A pump 144 is connected in fluid communication with the return conduit 139 for pumping the water contained within the reservoir 142 through the heat exchanger 146 via return conduit 139 and then through the precool/subcool system 10 to the spray heads 140 via conduits 141 and 143, respectively. Accordingly, it should be appreciated that only one pump 144 is required to circulate the water through the heat exchanger 146, air/water-cooled condenser 132, and the subcooler/precooler 10 of the invention. A water supply conduit 148 is connected to the input of the heat exchanger 146 to supply make-up water to the system which is lost by evaporation within the condenser 132.

The novel water and air-cooled condenser 132 achieves all of the benefits of both a straight air-cooled condenser and a water-cooled condenser. More particularly, the water sprayed from the spray heads 140 cools the refrigerant flowing through the condenser conduit 138 thereby causing the refrigerant to change from a gaseous to a liquid state. The sprayed water is simultaneously exposed to the atmosphere such that part of the water is evaporated to the atmosphere. The heat of vaporization lost to the atmosphere therefore reduces the ambient temperature of the water in the reservoir 142. The temperature of the water is further reduced by flowing the water through the heat exchanger 146 buried in the ground. The relatively cool water is then forced through the precool/subcool system 10 to precool and subcool the refrigerant flowing into and being discharged from the condenser conduit 138, respectively. The water is then sprayed through the spray heads 140 to be returned to the reservoir 142. The operating temperature of the refrigerant and the water as they flow throughout the system has been indicated within FIGS. 10-12. This should illustrate the fact that the condenser 132 operates to condense the refrigerant to a liquid at approximately 105° F. Moreover, the heat exchanger 146 operates to cool the water to approximately 72° F. prior to being supplied to the subcooler 26 of the invention.

The present disclosure includes that contained in the appended claims, as well as that of the foregoing description. Although this invention has been described in its preferred form with a certain degree of particularity, it is understood that the present disclosure of the preferred form has been made only by way of example and that numerous changes in the details of construction and the combination and arrangement of parts may be resorted to without departing from the spirit and scope of the invention.

Now that the invention has been described:

What is claimed is:

1. A precool and subcool system for precooling and subcooling a refrigerant passing through a condenser of a heat pump when the heat pump is operating in a cooling mode, comprising in combination:

a precooler connected in fluid communication with the input of the condenser enabling the refrigerant to flow through said precooler prior to flowing through the condenser;

a subcooler connected in fluid communication with the output of the condenser enabling the refrigerant to flow through said subcooler after flowing through the condenser;

said subcooler including a first heat exchanger means enabling a first fluid to flow through said subcooler in a heat exchanging relationship with the refrigerant thereby subcooling the refrigerant;

said precooler including a second heat exchanger means enabling a second fluid to flow through said precooler in a heat exchanging relationship with the refrigerant thereby precooling the refrigerant, and means for controlling the rate of flow of said first and said second fluids flowing through said first and said second heat exchanger whereby the refrigerant is precooled and subcooled to substantially a saturated-vapor state and a substantially subcooled-liquid state, respectively.

2. The precool and subcool system as set forth in claim 1, wherein the output of said first heat exchanger means is connected to the input of the second heat exchanger means whereby the first fluid comprises the second fluid which flows first through said first heat exchanger means and then through said second heat exchanger means thereby enabling the fluid to subcool the refrigerant flowing from the condenser and to precool the refrigerant flowing into the condenser.

3. The precool and subcool system as set forth in claim 2, wherein said first heat exchanger means and said second heat exchanger means includes means for preventing the fluid from mixing with the refrigerant.

4. A precool and subcool system for precooling and subcooling a refrigerant passing through a condenser of a heat pump when the heat pump is operating in a cooling mode, comprising in combination:

a precooler connected in fluid communication with the input of the condenser enabling the refrigerant to flow through said precooler prior to flowing through the condenser;

a subcooler connected in fluid communication with the output of the condenser enabling the refrigerant to flow through said subcooler after flowing through the condenser;

said subcooler including a first heat exchanger means enabling a first fluid to flow through said subcooler in a heat exchanging relationship with the refrigerant thereby subcooling the refrigerant;

said precooler including a second heat exchanger means enabling a second fluid to flow through said precooler in a heat exchanger relationship with the refrigerant thereby precooling the refrigerant;

the output of said first heat exchanger means being connected to the input of the second heat exchanger means whereby the first fluid comprises the second fluid which flows first through said first heat exchanger means and then through said second heat exchanger means thereby enabling the fluid to subcool the refrigerant flowing from the condenser and to precool the refrigerant flowing into the condenser;

said first heat exchanger means and said second heat exchanger means include means for preventing the fluid from mixing with the refrigerant;

said first heat exchanger means including a first fluid conduit disposed in a heat exchanging relationship with a first refrigerant conduit thereby enabling the fluid to subcool the refrigerant as the fluid and the refrigerant flow through the first fluid conduit and said first refrigerant conduit, respectively;

said second heat exchanger means including a second fluid conduit disposed in a heat exchanging relationship with a second refrigerant conduit thereby enabling the fluid to precool the refrigerant as the fluid and the refrigerant flow through said second fluid conduit and said second refrigerant conduit, respectively;

the output of said first fluid conduit being connected in fluid communication to the input of said second fluid conduit whereby the fluid flows first through said first fluid conduit and then through said second fluid conduit;

the input of said first refrigerant conduit being connected in fluid communication with the output of the condenser whereby the refrigerant flowing from the condenser sequentially flows through said first refrigerant conduit; and the output of said second refrigerant conduit being connected in fluid communication with the input of the condenser whereby the refrigerant flows through said second refrigerant conduit prior to flowing into the condenser.

5. A post heat and subcool system for post heating and subcooling a refrigerant passing through an evaporator of a heat pump when the heat pump is operating in a heating mode, comprising in combination:

a post heater connected in fluid communication with the output of the evaporator enabling the refrigerant to flow through said post heater after flowing through the evaporator;

a subcooler connected in fluid communication with the input of the evaporator enabling the refrigerant to flow through said subcooler prior to flowing through the evaporator;

said subcooler including a first heat exchanger means enabling a first fluid to flow through said subcooler in a heat exchanging relationship with the refrigerant thereby subcooling the refrigerant;

said post heater including a second heat exchanger means enabling a second fluid to flow through said post heater in a heat exchanging relationship with the refrigerant thereby post heating the refrigerant; and means for controlling the rate of flow of said first and said second fluids flowing through said first and said second heat exchanger whereby the refrigerant is post heated and subcooled to substantially a saturated-vapor state and a saturated-liquid state, respectively.

6. The post heat and subcool system as set forth in claim 5, wherein the output of said first heat exchanger means is connected to the input of the second heat exchanger means whereby the first fluid comprises the second fluid which flows first through said first heat exchanger means and then through said second heat exchanger means thereby enabling the fluid to subcool the refrigerant flowing into the evaporator and to post heat the refrigerant flowing from the evaporator.

7. The post heat and subcool system as set forth in claim 6, wherein said first heat exchanger means and said second heat exchanger means include means for preventing the fluid from mixing with the refrigerant.

8. A post heat and subcool system for post heating and subcooling a refrigerant passing through an evaporator of a heat pump when the heat pump is operating in a heating mode, comprising in combination:

a post heater connected in fluid communication with the output of the evaporator enabling the refrigerant to flow through said post heater after flowing through the evaporator;

a subcooler connected in fluid communication with the input of the evaporator enabling the refrigerant to flow through said subcooler prior to flowing through the evaporator;

said subcooler including a first heat exchanger means enabling a first fluid to flow through said subcooler in a heat exchanging relationship with the refrigerant thereby subcooling the refrigerant;

said post heater including a second heat exchanger means enabling a second fluid to flow through said post heater in a heat exchanging relationship with the refrigerant thereby post heating the refrigerant;

the output of said first heat exchanger means being connected to the input of the second heat exchanger means whereby the first fluid comprises the second fluid which flows first through said first heat exchanger means and then through said second heat exchanger means thereby enabling the fluid to subcool the refrigerant flowing into the evaporator and to post heat the refrigerant flowing from the evaporator;

said first heat exchanger means and said second heat exchanger means includes means for preventing the fluid from mixing with the refrigerant;

said first heat exchanger means including a first fluid conduit disposed in a heat exchanging relationship with a first refrigerant conduit thereby enabling the fluid to subcool the refrigerant as the fluid and the refrigerant flow through said first fluid conduit and said first refrigerant conduit, respectively;

said second heat exchanger means including a second fluid conduit disposed in a heat exchanging relationship with a second refrigerant conduit thereby enabling the fluid to post heat the refrigerant as the fluid and the refrigerant flow through the second fluid conduit and the second refrigerant conduit, respectively;

the output of said first fluid conduit being connected in fluid communication to the input of said second fluid conduit whereby the fluid flows first through said first fluid conduit and then through said second fluid conduit;

the output of said first refrigerant conduit being connected in fluid communication with the input of the evaporator whereby the refrigerant flows through said first refrigerant conduit prior to flowing into the evaporator; and the input of said second refrigerant conduit being connected to fluid communication with the output of the evaporator whereby the refrigerant flowing from the evaporator sequentially flows through said second refrigerant conduit.

9. A method for increasing the efficiency and cooling capacity of a heat pump including an evaporator, a compressor, and a condenser operating in a cooling mode, comprising the steps of:

subcooling the refrigerant flowing from the condenser;

precooling the refrigerant prior to the refrigerant flowing through the condenser;

the step of precooling the refrigerant including the step of flowing a first fluid, having a temperature less than the temperature of the refrigerant, in a heat exchanging relationship with the refrigerant whereby the temperature of the refrigerant is decreased;

the step of subcooling the refrigerant including the step of flowing of a second fluid, having a temperature less than the temperature of the refrigerant, in a heat exchanging relationship with the refrigerant whereby the temperature of the refrigerant is decreased; and regulating the flow rate of the fluid to subcool the refrigerant flowing from the condenser to a subcooled-liquid state and to precool the refrigerant flowing into the condenser to at least a saturated-vapor state.

10. The method as set forth in claim 9, wherein said first fluid comprises said second fluid such that said fluid first flows in a heat exchanging relationship with the refrigerant flowing from the condenser and then flows in a heat exchanging relationship with the refrigerant flowing into the condenser.

11. The method as set forth in claim 9, wherein the flow rate of the fluid is increased to precool the refrigerant flowing into the condenser to a mixed-phase state.

12. A method for increasing the efficiency and heating capacity of a heat pump including an evaporator, a compressor, and a condenser operating in a heating mode, comprising the steps of:

subcooling the refrigerant prior to the refrigerant flowing through the evaporator;

postheating the refrigerant flowing from the evaporator;

the step of postheating the refrigerant including the step of flowing a first fluid, having a temperature greater than the temperature of the refrigerant, in a heat exchanging relationship with the refrigerant;

the step of subcooling the refrigerant including the step of flowing of a second fluid, having a temperature less than the temperature of the refrigerant, in a heat exchanging relationship with the refrigerant;

regulating the flow rate of said first fluid to subcool the refrigerant flowing into the evaporator to a subcooled state and to postheat the refrigerant flowing from the evaporator to at least a saturated-vapor state.

13. The method as set forth in claim 12, wherein the flow rate of said first fluid is increased to postheat the refrigerant flowing from the evaporator to a superheated state.

14. A combination air-cooled and water-cooled condenser for a heat pump including a compressor, a condenser, and an evaporator charged with a refrigerant and operating in a cooling mode, comprising in combination:

a plurality of horizontally disposed baffles;

said baffles being sloped inwardly toward one another;

a refrigerant conduit rigidly connected to the lowermost edge of said baffles;

a spray head disposed above said baffles for spraying a fluid onto said baffles;

a reservoir located beneath said baffles for receiving the fluid being sprayed from said spray head;

a heat exchanger means;

a first conduit connecting the output of said reservoir in fluid communication with the input of said heat exchanger means;

a second conduit for connecting the output of said heat exchanger to said spray head;

means for circulating the water from said reservoir, through said heat exchanger, and to said spray head;

means for connecting the input of said refrigerant conduit in fluid communication with the output of the compressor;

and means for connecting the output of said refrigerant conduit in fluid communication with the input of the evaporator.

15. The condenser as set forth in claim 14, wherein said refrigerant conduit is connected to said baffles in a position such that the refrigerant flowing from the compressor flows first through the portion of said refrigerant conduit connected to the upper said baffles and then flows through the other portion of said drefrigerant conduit connected to the lower said baffles.

16. The condenser as set forth in claim 14, wherein said heat exchanger is disposed within the earth such that the water flowing therethrough is cooled to a temperature approximately equal to the temperature of the earth at the depth at which said heat exchanger is located.

17. The condenser as set forth in claim 14, further comprising a supply conduit connected in fluid communication with said reservoir to maintain said reservoir at a predetermined level.

18. The precool and subcool system as set forth in claim 2, wherein the condenser of the heat pump comprises in combination:

a plurality of horizontally disposed baffles;

said baffles being sloped inwardly toward one another;

a refrigerant conduit rigidly connected to the lowermost edge of said baffles;

a spray head disposed above said baffles for spraying the fluid onto said baffles;

a reservoir located beneath said baffles for receiving the fluid being sprayed from said spray head;

a third heat exchanger means;

a first conduit connecting the output of said reservoir in fluid communication with the input of said third heat exchanger means;

a second conduit for connecting the output of said third heat exchanger to the input of said subcooler;

a third conduit for connecting the output of said precooler to said spray head;

means for circulating the water from said reservoir, through said third heat exchanger, through said subcooler and said precooler, and to said spray head;

means for connecting the input of said refrigerant conduit in fluid communication with the output of said precooler enabling the refrigerant flowing from said precooler to flow through said refrigerant conduit, and means for connecting the output of said refrigerant conduit in fluid communication with the input of said subcooler enabling the refrigerant flowing through said refrigerant conduit to flow to said subcooler.

19. The precool and subcool system as set forth in claim 18, wherein said refrigerant conduit is connected to said baffles in a position such that the refrigerant flowing from said precooler flows first through the portion of said refrigerant conduit connected to the upper said baffles and then flows through the other portion of said refrigerant conduit connected to the lower said baffles.

20. The precool and subcool system as set forth in claim 18, wherein said third heat exchanger is disposed within the earth such that the water flowing therethrough is cooled to a temperature approximately equal to the temperature of the earth at the depth at which said heat exchanger is located.

21. The precool and subcool system as set forth in claim 18, further comprising a supply conduit connected in fluid communication with said reservoir to maintain said reservoir at a predetermined level.

22. A precool and subcool system for precooling and subcooling a refrigerant passing through a condenser of a heat pump when the heat pump is operating in a cooling mode, comprising in combination:

a precooler refrigerant conduit connected in fluid communication with the input of the condenser enabling the refrigerant to flow through said precooler refrigerant conduit prior to flowing through the condenser;

a subcooler refrigerant conduit connected in fluid communication with the output of the condenser enabling the refrigerant to flow through said subcooler after flowing through the condenser;

a subcooler fluid conduit disposed in a heat exchanging in relationship with said subcooler refrigerant conduit;

a precooler fluid conduit disposed in a heat exchanging in relationship with said precooler refrigerant conduit; and means for connecting the output of said subcooler fluid conduit in fluid communication with the input of said precooler fluid conduit enabling a fluid to flow first through said subcooler fluid conduit and then through said precooler fluid conduit thereby subcooling the refrigerant flowing from the condenser and precooling the refrigerant flowing into the condenser.

23. A post heat and subcool system for post heating and subcooling a refrigerant passing through an evaporator of a heat pump when the heat pump is operating in the heating mode, comprising in combination:

a refrigerant conduit connected in fluid communication with the input of the evaporator enabling the refrigerant to flow through said subcooler refrigerant conduit prior to flowing through the evaporator;

a post heater refrigerant conduit connected in fluid communication with the output of the evaporator enabling the refrigerant to flow through said post heater refrigerant conduit after flowing through the evaporator;

a subcooler fluid conduit connected in a heat exchanging relationship with said subcooler refrigerant conduit;

a post heater fluid conduit connected in a heat exchanging relationship with said post heater refrigerant conduit; and means for connecting the output of said subcooler fluid conduit in fluid communication with the input of said post heater fluid conduit enabling a fluid to flow first through said subcooler fluid conduit and then through said post heater fluid conduit thereby subcooling the refrigerant flowing into the evaporator and post heating the refrigerant flowing from the evaporator.

* * * * *